US007753358B2

(12) United States Patent
Ikeda

(10) Patent No.: US 7,753,358 B2
(45) Date of Patent: Jul. 13, 2010

(54) TABBED SHEET SUPPORT UNIT, SHEET FEEDING DEVICE, AND IMAGE FORMING APPARATUS

(75) Inventor: Taro Ikeda, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/141,344

(22) Filed: Jun. 18, 2008

(65) Prior Publication Data

US 2008/0315498 A1 Dec. 25, 2008

(30) Foreign Application Priority Data

Jun. 20, 2007 (JP) ..... 2007-162860

(51) Int. Cl.
*B65H 3/14* (2006.01)
*B65H 3/34* (2006.01)
*B65H 3/52* (2006.01)

(52) U.S. Cl. ..... 271/104; 271/96; 271/123

(58) Field of Classification Search ..... 271/104, 271/123, 137, 97, 98, 34
See application file for complete search history.

(56) References Cited

U.S. PATENT DOCUMENTS 1,675,525 A * 7/1928 Aldrich ..... 271/104
4,575,298 A * 3/1986 Maas et al. ..... 414/795.5
5,135,213 A * 8/1992 Malachowski et al. ..... 271/104
5,190,276 A * 3/1993 Namba et al. ..... 271/13
5,290,023 A * 3/1994 Sasaki et al. ..... 271/20
5,645,274 A 7/1997 Ubayashi et al. ..... 271/94
5,893,554 A * 4/1999 Okahashi et al. ..... 271/98
6,113,092 A * 9/2000 Greive et al. ..... 271/113
6,746,011 B2 * 6/2004 Miller et al. ..... 271/97
2007/0228639 A1 10/2007 Matsumoto et al. ..... 271/97
2007/0284805 A1 12/2007 Ikeda ..... 271/11

FOREIGN PATENT DOCUMENTS

JP 7-196187 8/1995
JP 2000-229732 8/2000

* cited by examiner

*Primary Examiner*—Patrick Mackey
*Assistant Examiner*—Patrick Cicchino
(74) *Attorney, Agent, or Firm*—Fitzpatrick, Cella, Harper & Scinto

(57) ABSTRACT

A tabbed sheet table is detachably attached to a lifting and lowering tray when a tabbed sheet is fed. A tabbed sheet regulating member is provided in a side surface on an upstream side in a sheet feeding direction of the tabbed sheet table while being movable in a vertical direction. The tabbed sheet regulating member includes an abutting portion and a contacting portion. The abutting portion is vertically extended, and the abutting portion abuts on a tab of the tabbed sheet. The contacting portion is extended along the tabbed sheet table, and the contacting portion is contacted on the top-most tabbed sheet placed on the tabbed sheet table. In lifting a tray, a length in a vertical direction of the tabbed sheet is set such that a state in which the regulating member is contacted on the tabbed sheet is maintained irrespective of the lifting of the tray.

12 Claims, 16 Drawing Sheets

TABBED SHEET SUPPORT UNIT, SHEET FEEDING DEVICE, AND IMAGE FORMING APPARATUS

BACKGROUND OF THE INVENTION

1. Field of the Invention

The present invention relates to tabbed sheet support unit which is used to feed a tabbed sheet, a sheet feeding apparatus, and an image forming apparatus.

2. Description of the Related Art

Conventionally, an image forming apparatus such as a printer and a copying machine includes a sheet feeding apparatus feeding a sheet one by one from a sheet storage portion in which plural sheets are stored. For example, Japanese Patent Application Laid-Open No. 7-196187 discloses an air sheet feeding system sheet feeding apparatus in which plural sheets are floated by spraying air on an end part of a sheet bundle supported by a lifting and lowering tray and only one sheet is drawn onto a suction conveying belt provided above.

FIG. 10 illustrates an example of the air sheet feeding system sheet feeding apparatus. As shown in FIG. 10, a lifting and lowering tray 12 on which plural sheets S are stacked and supported is provided in a storage case 11. The storage case 11 is of a sheet storage portion in which the sheets S are stored.

When the sheet S are set on the tray 12, positions of the sheets S are retained at an end (hereinafter referred to as front end) on a downstream side in a sheet feeding direction by a front-end regulating plate 17, and the positions of the sheets S are retained at an end (hereinafter referred to as rear end) on an upstream side in the sheet feeding direction by a rear-end regulating plate 13. The positions of the sheets S are also retained at both side ends in a direction (hereinafter referred to as width direction) orthogonal to the sheet feeding direction by a side regulating plate 14.

A suction conveying portion 20 and an air spraying portion 30 are provided above the storage case 11. The suction conveying portion 20 draws and conveys the sheet S. The air spraying portion 30 sprays the air on the end part of the sheet bundle on the tray to float the plural sheets S, and the air spraying portion 30 separates the sheets S one by one.

The suction conveying portion 20 includes a suction conveying belt 21, a suction fan 36, a suction duct 22, and a suction shutter 37. The suction conveying belt 21 is wrapped about a belt driving roller 41, and the suction conveying belt 21 draws the sheet S to convey the sheet S in a right direction of FIG. 10. The suction fan 36 generates a negative pressure in order to cause the suction conveying belt 21 to suck the sheet S. The suction duct 22 is disposed inside the suction conveying belt 21, and the suction duct 22 draws the air through suction holes made in the suction conveying belt 21. The suction shutter 37 is provided between the suction fan 36 and the suction duct 22 in order to turn on and off a suction operation of the suction fan 36.

The air spraying portion 30 includes a loosening nozzle 33, a separation nozzle 34, a separation fan 31, and a separation duct 32. The loosening nozzle 33 and the separation nozzle 34 spray the air on an upper part of the stored sheet bundle. The separation duct 32 supplies the air from the separation fan 31 to the loosening nozzle 33 and the separation nozzle 34.

Part of the air drawn in a direction of arrow C by the separation fan 31 passes through the separation duct 32, and the part of the air is sprayed in a direction of an arrow D through the loosening nozzle 33 to float several sheets in the upper part of the sheet bundle supported on the tray 12. The remaining air is sprayed in a direction of an arrow E through the separation nozzle 34, and the remaining air individually separates the top-most sheet in the several sheets floated by the loosening nozzle 33 and presses the top-most sheet against the suction conveying belt 21.

Frequently the sheet feeding apparatus is adopted for a high-speed machine which can feed 70 A4-size sheets or more per minute. The tray 12 includes a mechanism in which a driving unit (not illustrated) lifts and lowers the tray 12 in a vertical direction while keeping the tray 12 substantially horizontal.

FIG. 11 is a plan view illustrating the detailed storage case 11. Referring to FIG. 11, the rear-end regulating plate 13 which regulates the sheet rear end is disposed while being movable in parallel with the sheet feeding direction illustrated by an arrow H, and the side regulating plates 14 and 16 which regulate the sheet side ends are disposed while being movable in the sheet width direction illustrated by an arrow V.

Thus, the rear-end regulating plate 13 and the side regulating plates 14 and 16 are movably disposed so that a minimum-size sheet SS to a maximum-size sheet LS can be stacked and supported on the tray 12. In order not to obstruct the movement of the side regulating plate 14, the rear-end regulating plate 13 is disposed so as to be movable only in a central part in the width direction of the tray 12.

Recently, in the image forming apparatus, a demand for producing a brochure is increased, and sometimes a sheet in which a tab is attached to an end part thereof (hereinafter referred to as tabbed sheet) is used. Therefore, it is necessary to feed the tabbed sheet from the sheet feeding apparatus, and it is also necessary to be able to feed the tabbed sheet in the air sheet feeding system sheet feeding apparatus.

FIG. 12 illustrates a state in which tabbed sheets TS having given sizes are set in the air sheet feeding system sheet feeding apparatus. In FIG. 12, the tabbed sheets TS are supported by the tray 12 while tabs TSa are located on the upstream side in the sheet feeding direction, the side regulating plates 14 abuts on the side ends of the tabbed sheets TS, and the rear-end regulating plate 13 abuts on the tabs TSa of the tabbed sheets TS.

When the feeding operation is started, the air is sprayed on the front-end sides of the tabbed sheets TS from the loosening nozzle 33 and the separation nozzle 34 as illustrated in FIG. 13. At this point, because the rear-end regulating plate 13 is provided only in the central part, some of the tabbed sheets TS in which the rear-end regulating plate 13 does not abut on the tabs TSa, for example, the top-most and second tabbed sheets TS are moved rearward up to a width TD of the tab TSa in a direction of an arrow T.

The tabbed sheets TS whose tabs cannot be regulated by the rear-end regulating plate 13 are away from the loosening nozzle 33 when moved rearward, which weakens a wind pressure against the tabbed sheets TS. Therefore, as shown in FIG. 14, for example, front-end parts TF of the top-most and second tabbed sheets TS1 and TS2 whose tabs cannot be regulated by the rear-end regulating plate 13 are insufficiently floated and bent. As a result, the air sprayed from the loosening nozzle 33 hardly enters a gap between the sheets, and the sheet front end cannot properly be loosened.

Because the top-most and second tabbed sheets TS1 and TS2 are unstably floated, other sheets also becomes unstable floating states by the influence of the unstable top-most and second tabbed sheets TS1 and TS2, and therefore the other sheets repeat vertical movement in a direction of an arrow R as illustrated in FIG. 14. The generation of the floating state illustrated in FIG. 14 causes troubles such as multi feed, a jam due to a failure of suction to the suction conveying belt 21, and generation of a folded sheet corner.

The feed of tabbed sheets is needed not only in the air sheet feeding system sheet feeding apparatus but also a sheet feeding apparatus having a configuration in which the sheet is fed by a roller while the tray on which the sheets are stacked is lifted and lowered by a lifter mechanism.

However, in the sheet feeding apparatus in which the sheet is fed by the roller, similarly to the air sheet feeding system sheet feeding apparatus, the tab cannot be regulated by the rear-end regulating member, and sometimes the sheet is shifted rearward. In such cases, when the roller which delivers the sheet is disposed on the front end side of the sheet, the sheet cannot be delivered, which sometimes causes a failure of the sheet feed. Even if the sheet can be delivered, because timing at which the sheet is delivered is largely shifted, an interval between the sheets is broadened to lower the productivity or to generate a risk of detecting delay jam.

In order to solve the problem, for example, Japanese Patent Application Laid-Open No. 2000-229732 discloses a technique in which a tab guide dedicated to the tabbed sheet is optionally attached so as to abut on all the tabs TSa of the tabbed sheets TS.

However, in the air sheet feeding system sheet feeding apparatus, it is necessary to attach the tab guide dedicated to the tabbed sheet to an upper surface of the tray 12. When a tab guide 13M as illustrated in FIG. 15 is provided, because areas shown by oblique lines of the tab guide 13M overlap the tray 12, the tab guide 13M cannot be fixed to the storage case 11. That is, it is necessary that the tab guide which abuts on all the tabs TSa of the tabbed sheet TS be attached to the upper surface of the tray 12.

As illustrated in FIG. 16, the tabbed sheet TS is fed, the tray 12 is lifted according to the decrease in the residual sheet, and the tab guide 13M is lifted along with the tray 12. Even if the tab guide 13M is lifted, in order that the tab guide 13M collides with a component 40 constituting the image forming apparatus body, it is necessary to suppress a height of the tab guide 13M.

However, when the height of the tab guide 13M is decreased as illustrated in FIG. 16, a height in which the tab guide 13M can guide the tabbed sheet TS is decreased, and an amount of tabbed sheet TS stacked on the tray 12 is largely decreased. Accordingly, the number of supply times of the tabbed sheets TS is increased, which remarkably deteriorates apparatus operability and productivity.

SUMMARY OF THE INVENTION

The present invention provides an apparatus which can obtain the high operability and productivity even if the tabbed sheets are fed.

In accordance with an aspect of the invention, a tabbed sheet support unit which can be attached to a sheet feeding apparatus in order to support a tabbed sheet, the sheet feeding apparatus including a tray and a sheet feeding portion, the tray stacking and supporting the sheet, the tray being lifted and lowered according to an amount of stacked sheet, the sheet feeding portion feeding the sheet stacked on the tray, the tabbed sheet support unit includes a stacking portion which is detachably attached to the tray to stack the tabbed sheet; and a regulating portion which is provided in the stacking portion, the regulating portion abutting on a tab of the stacked tabbed sheet to regulate a position of the tab, wherein the regulating portion is movably supported by the stacking portion according to the amount of tabbed sheet stacked on the stacking portion, when the stacking portion is attached to the tray.

Further features of the present invention will become apparent from the following description of exemplary embodiments (with reference to the attached drawings).

DESCRIPTION OF THE EMBODIMENTS

An exemplary embodiment of the invention will be described below with reference to the drawings.

Figure 1:
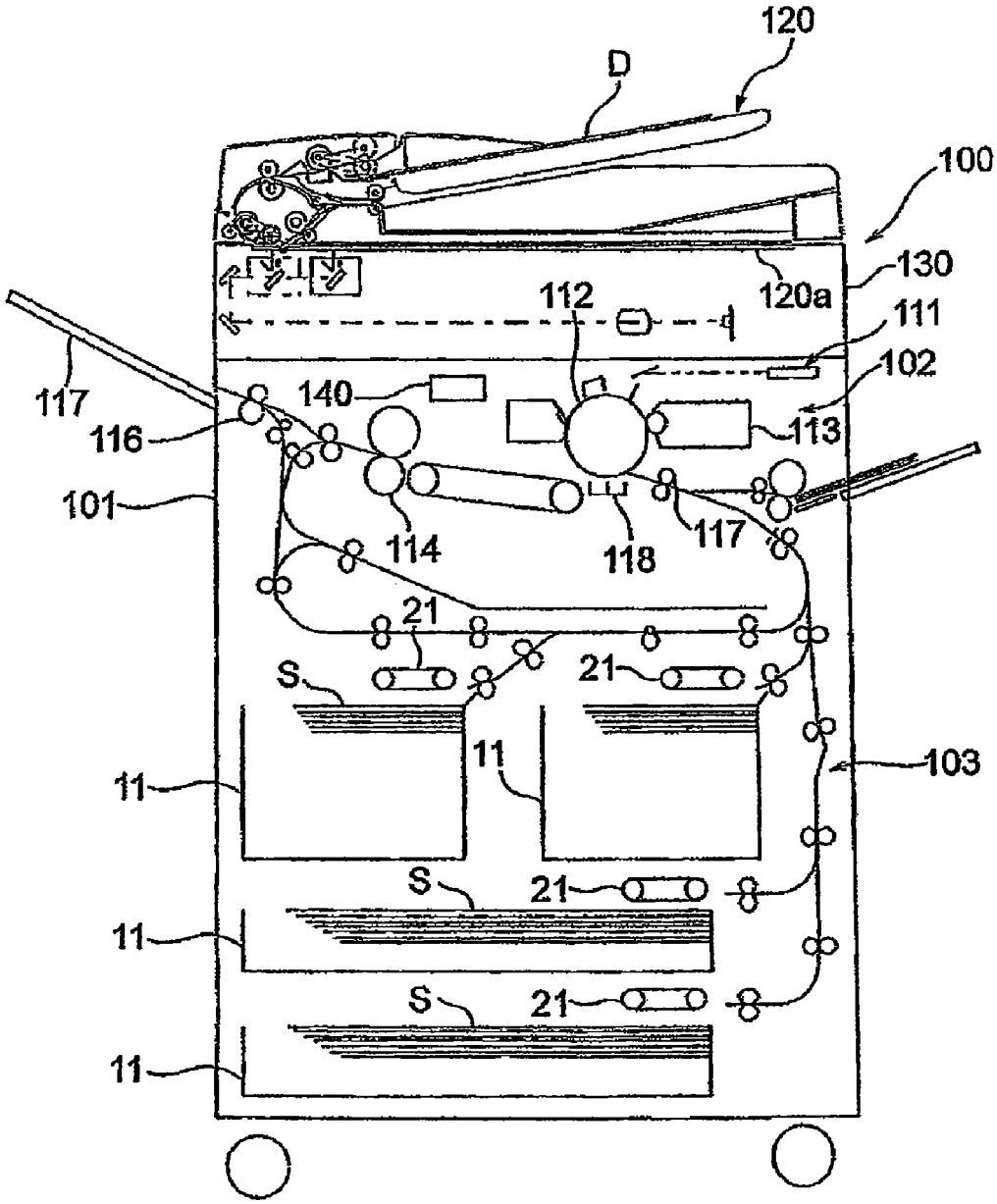
FIG. 1 illustrates a schematic configuration of a printer which is of an example of an image forming apparatus provided with a sheet feeding apparatus according to an embodiment of the invention.

FIG. 1 illustrates a schematic configuration of a printer which is of an example of an image forming apparatus provided with a sheet feeding apparatus according to an embodiment of the invention.

In FIG. 1, there are shown a printer 100 and a printer body 101. An image scanning portion 130 is provided in the upper part of the printer body 101. The image scanning portion 130 scans an original, and an automatic original feeder 120 places the original on a platen glass 120*a* which is of an original placing platen. An image forming portion 102 and a sheet feeding apparatus 103 are provided below the image scanning portion 130. The sheet feeding apparatus 103 feeds a sheet S to the image forming portion 102.

The image forming portion 102 includes a photosensitive drum 112, a development device 113, and a laser scanner unit 111. The sheet feeding apparatus 103 includes the plural sheet storage cases 11 and a suction conveying belt 21 which is of a feeding belt. The sheets S such as OHT are stored in the sheet storage cases 11, and the sheet storage cases 11 are detachably attached to the printer body 101. The feeding belt is an example of a sheet feeding unit which delivers the sheets S stored in the sheet storage case 11. A controller 140 controls an image forming operation and a sheet feeding operation of the printer 100.

The image forming operation of the printer 100 will be described below.

The image scanning portion 130 scans an image when the controller 140 supplies an image scanning signal to the image scanning portion 130. Then, a laser scanner unit 111 emits a laser beam according to an electric signal of the scanned image to irradiate a photosensitive drum 112.

At this point, the photosensitive drum 112 is previously charged, and an electrostatic latent image is formed by the laser beam irradiation. Then, a development device 113 develops the electrostatic latent image to form a toner image on the photosensitive drum 112.

The sheet S is supplied from the sheet storage case 11 when the controller supplies a sheet feeding signal to the sheet feeding apparatus 103. Then, a registration roller 117 conveys the sheet S to a transfer portion in synchronization with the toner image on the photosensitive drum 112. The transfer portion includes the photosensitive drum 112 and a transfer charger 118.

Figure 2:
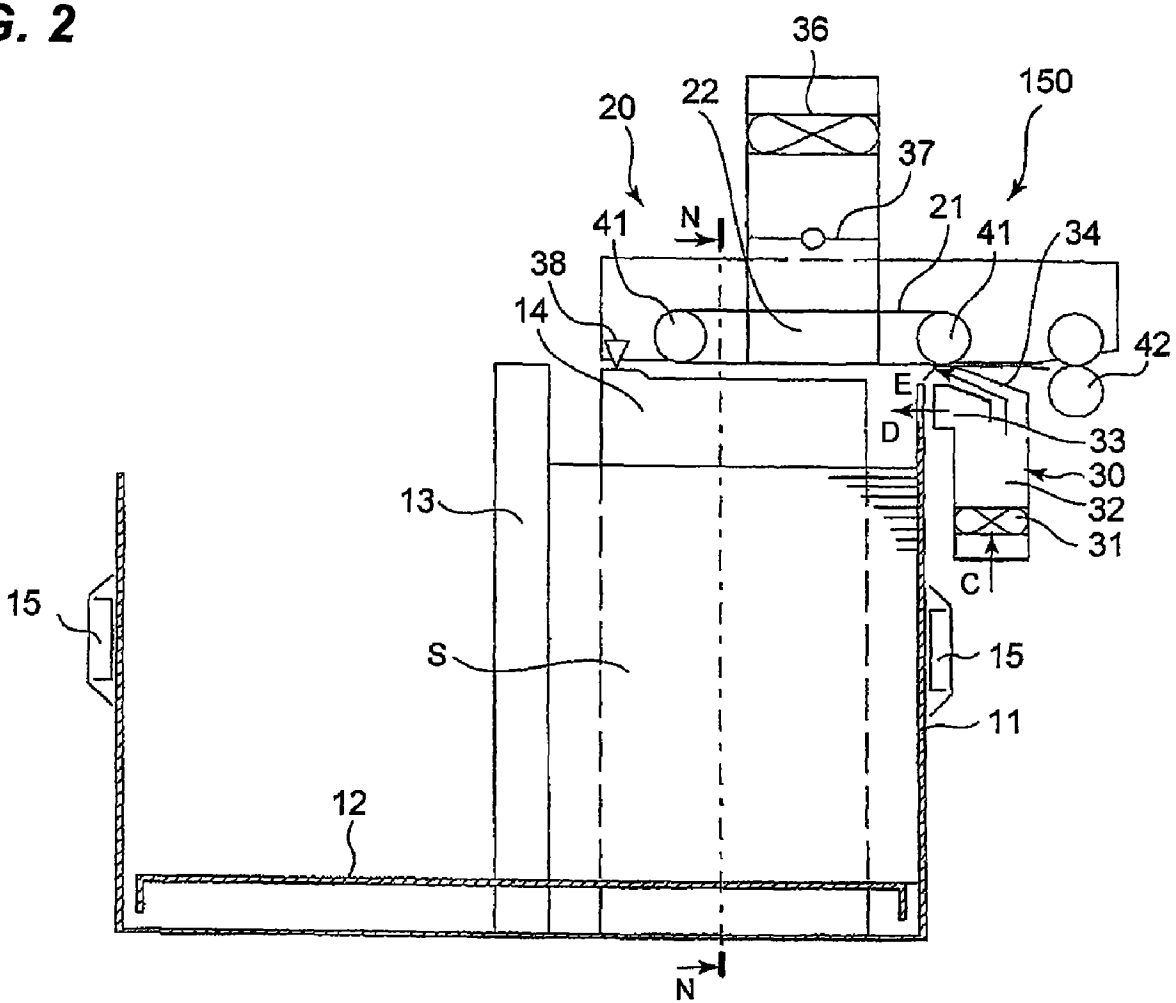
FIG. 2 illustrates a configuration of the sheet feeding apparatus.

The toner image is transferred to the sheet S conveyed to the transfer portion, and the sheet is transferred to a fixing portion 114. Then, the fixing portion 114 heats and pressurizes the sheet S to permanently fix the unfixed transfer image to the sheet S. A discharge roller 116 discharges the sheet to which the image is transferred from the printer body 101 to the discharge tray 117. FIG. 2 illustrates a configuration of the sheet feeding apparatus 103.

The sheet storage case 11 includes the tray 12, the rear-end regulating plate 13, and the side-end regulating plate 14. The plural sheets are stacked on and supported by the tray 12, and the tray 12 can be lifted and lowered. The rear-end regulating plate 13 regulates the rear side of the sheet S. The side-end regulating plate 14 regulates a position in the width direction of the sheet S. In the rear-end regulating plate 13 and the side-end regulating plate 14, the position can arbitrarily be changed according to the size of the stored sheet. The tray 12 is lifted and lowered by a driving unit (not illustrated). The driving unit is controlled such that the tray 12 can be lifted when the number of stacked sheets is decreased and such that the tray 12 is lowered when the sheet is run out. The sheet storage case 11 can be drawn from printer body 101 by the slide rail 15.

A sheet feeding mechanism (hereinafter referred to as air sheet feeding mechanism 150) is disposed above the sheet storage case 11. The air sheet feeding mechanism 150 constitutes the air sheet feeding system sheet feeding portion which individually separates and feeds the sheet on the tray. The air sheet feeding mechanism 150 includes the suction conveying portion 20 and the air spraying portion 30. The suction conveying portion 20 conveys the sheet S stacked on the tray 12 while using suction to attract the sheet S. The air spraying portion 30 floats the upper part of the sheet bundle on the tray, and the air spraying portion 30 separates the sheet S one by one.

The suction conveying portion 20 includes the suction conveying belt 21, the suction fan 36, and the suction duct 22. The suction conveying belt 21 is entrained about the belt driving roller 41, and the suction conveying belt 21 conveys the sheet S toward the right as viewed in FIG. 2 while using suction to attract the sheet S. The suction fan 36 generates a negative pressure in order to suck the sheet S to the suction conveying belt 21. The suction duct 22 is disposed inside the suction conveying belt 21, and the suction duct 22 is used to suck the air through the suction holes (not illustrated) made in the suction conveying belt 21.

The suction conveying portion 20 also includes the suction shutter 37. The suction shutter 37 is disposed between the suction fan 36 and the suction duct 22 to turn on and off the suction operation of the suction conveying belt 21. In the embodiment, the plural suction conveying belts 21 are disposed at predetermined intervals in the width direction.

The air spraying portion 30 includes the loosening nozzle 33, the separation nozzle 34, the separation fan 31, and the separation duct 32. The loosening nozzle 33 and the separation nozzle 34 spray the air on the upper part of the stored sheet S. The separation duct 32 supplies the air from the separation fan 31 to the loosening nozzle 33 and the separation nozzle 34.

Part of the air drawn in the direction of the arrow C by the separation fan 31 passes through the separation duct 32, and the part of the air is sprayed in the direction of the arrow D through the loosening nozzle 33 to float several sheets in the upper part of the sheet S supported on the tray 12. The remaining air is sprayed in the direction of the arrow E through the separation nozzle 34, and the remaining air individually separates the sheet floated by the loosening nozzle 33 and presses the sheet against the suction conveying belt 21.

A sheet surface detecting sensor 38 is disposed on the upstream side of the suction conveying belt 21 to detect a position of a top surface of the sheets stacked on the tray 12. The lifting and lowering of the tray 12 are controlled based on the sheet surface detecting sensor 38, and the sheet is fed when the top surface of the sheet is located at the optimum position.

A sheet detection sensor (not illustrated) is provided adjacent to the sheet surface detecting sensor 38. When the sheet is run out on the tray 12, a flag (not illustrated) enters an opening (not illustrated) formed in the tray 12, whereby the sheet detection sensor detects absence of the sheet.

The sheet feeding operation of the sheet feeding apparatus 103 (air sheet feeding mechanism 150) will be described below.

Figure 3:
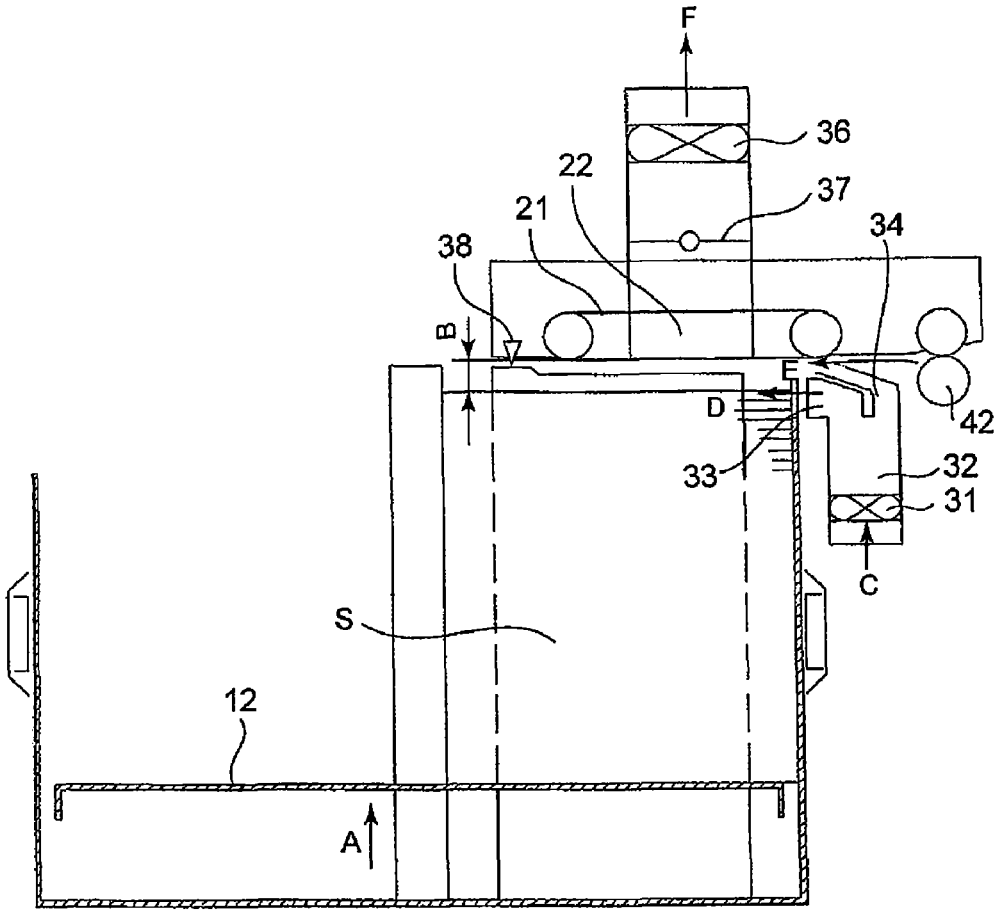
FIG. 3 is a first view illustrating a sheet feeding operation of the image forming apparatus.

A user draws the sheet storage case 11 to set the sheets S on the tray 12, and the user stores the sheet storage case 11 at a position as illustrated in FIG. 2. Then, as illustrated in FIG. 3, the tray 12 is lifted in the direction of the arrow A by the driving unit (not illustrated). When a distance between the suction conveying belt 21 and the top-most sheet Sa on the tray 12 reaches a position B where the sheet can be fed, the controller 140 stops the tray 12 at the position B. Then, the controller 140 waits for a sheet feeding signal before starting the sheet feed.

When the controller 140 detects the sheet feeding signal, the controller 140 actuates the separation fan 31 to suck the air in the direction of the arrow C. The air passes through the separation duct 32, and the air is sprayed on the sheet S on the tray 12 from the directions of the arrows D and E through the loosening nozzle 33 and the separation nozzle 34 respectively. Therefore, several upper sheets S are floated.

The controller 140 also actuates the suction fan 36 to exhaust the air in the direction of the arrow F. At this point, the suction shutter 37 is still closed. The lifting and lowering of the tray 12 is controlled based on the detection of the sheet surface detecting sensor 38, and the tray 12 is stopped when the top surface of the sheet is located at the optimum position.

Figure 4:
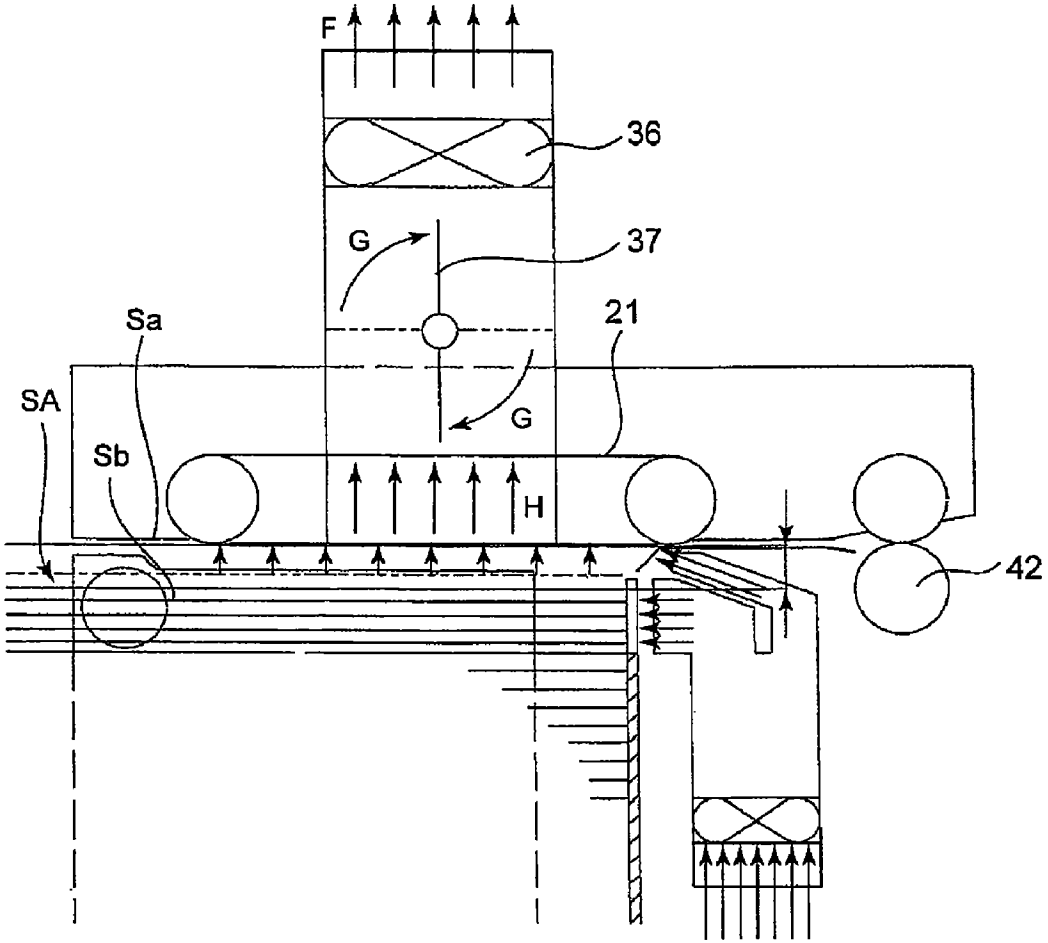
FIG. 4 is a second view illustrating the sheet feeding operation of the image forming apparatus.

When the floating of the upper sheet SA is stabilized as illustrated in FIG. 4 after a predetermined time elapses since the sheet feeding signal is detected, the controller 140 rotates the suction shutter 37 in the direction of the arrow G to generate a suction force in the direction of the arrow H from the suction holes made in the suction conveying belt 21. Only the top-most sheet Sa is sucked to the suction conveying belt 21 by the suction force and the separation air from the separation nozzle 34.

Figure 5:
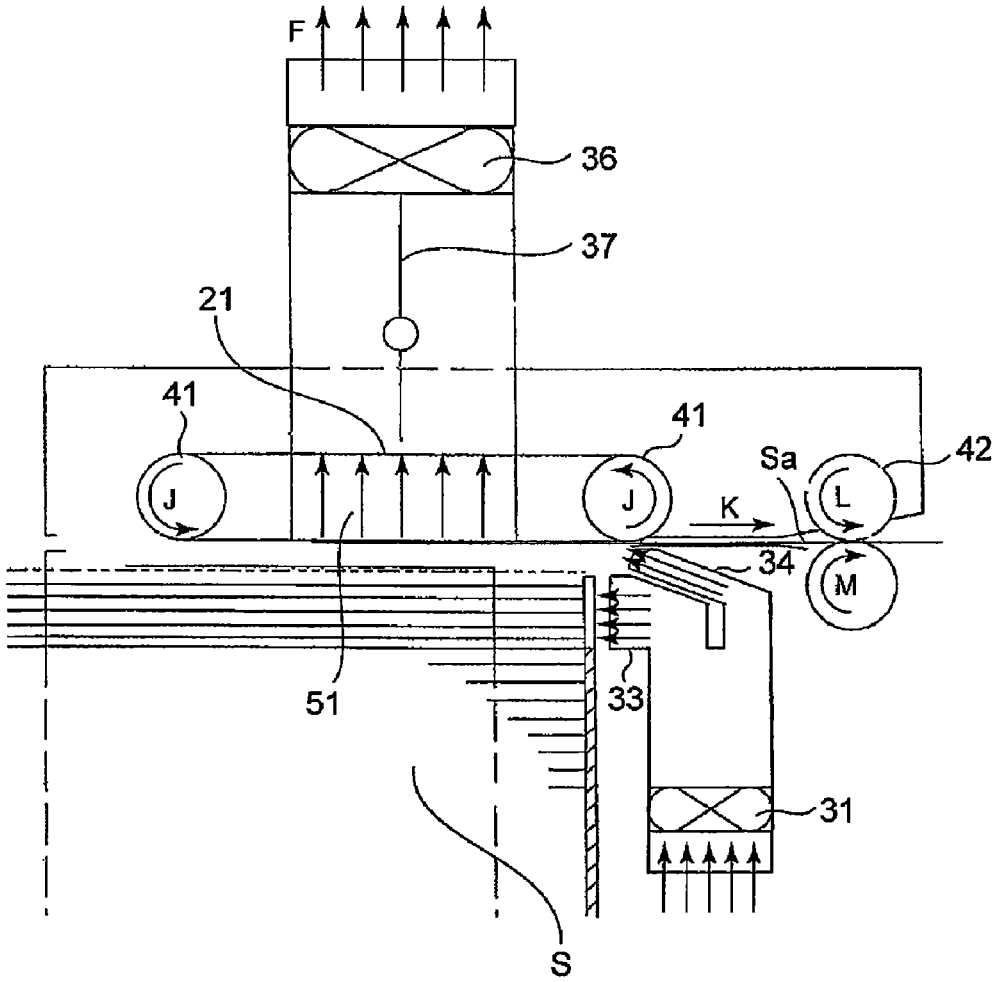
FIG. 5 is a third view illustrating the sheet feeding operation of the image forming apparatus.

Then, as illustrated in FIG. 5, the rotation of the belt driving roller 41 in the direction of the arrow J conveys the top-most sheet Sa in the direction of the arrow K while the top-most sheet Sa is sucked to the suction conveying belt 21, and the top-most sheet Sa is conveyed toward the image forming portion by a pair of drawing rollers 42 rotated in the directions of arrow L and M. In the embodiment, a tabbed sheet support unit which can support the tabbed sheet is detachably attached to the tray 12.

Figure 6:
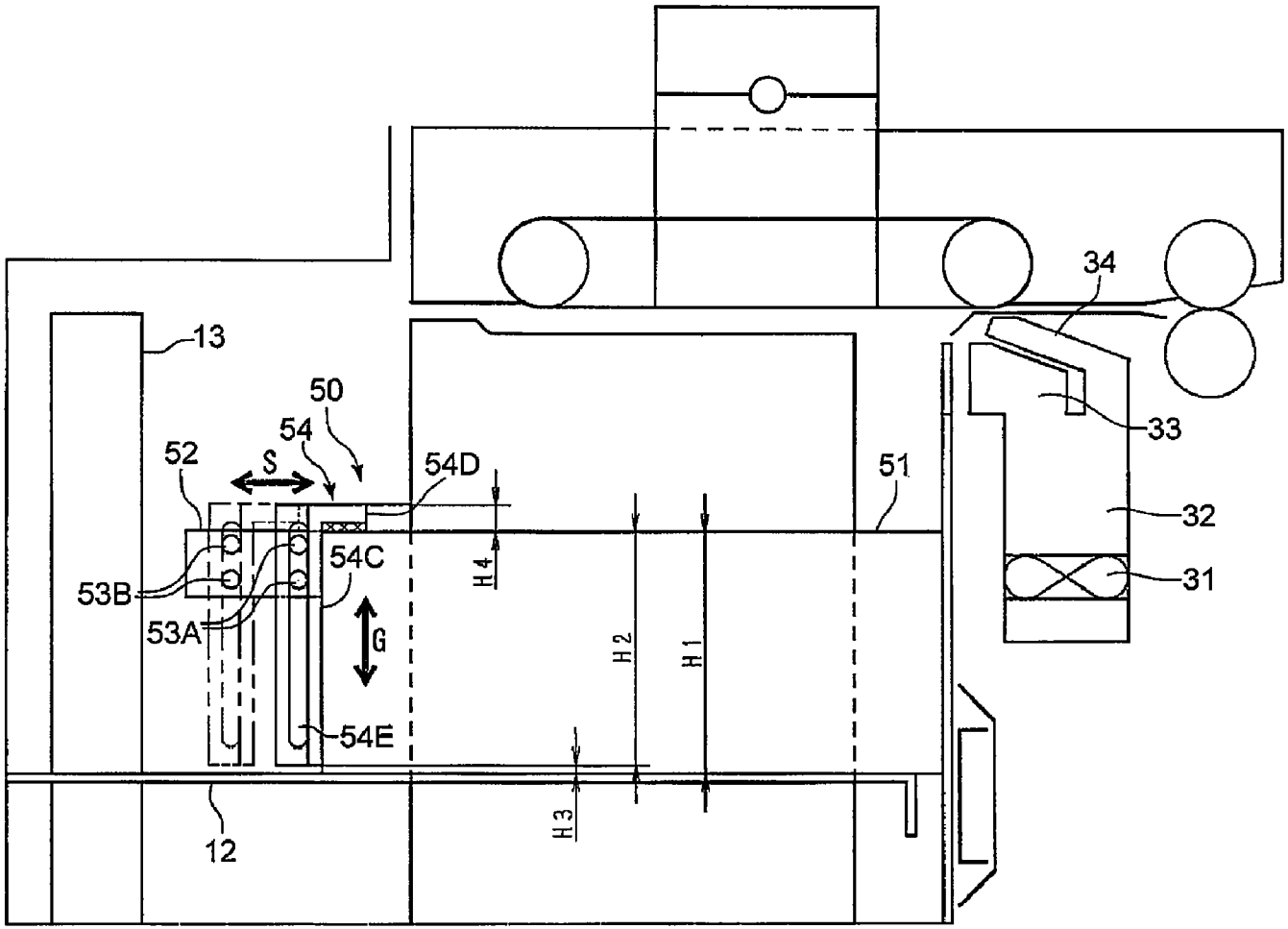
FIG. 6 is a sectional side view illustrating a state in which a tabbed sheet support unit is set in a tray of the sheet feeding apparatus.
Figure 7:
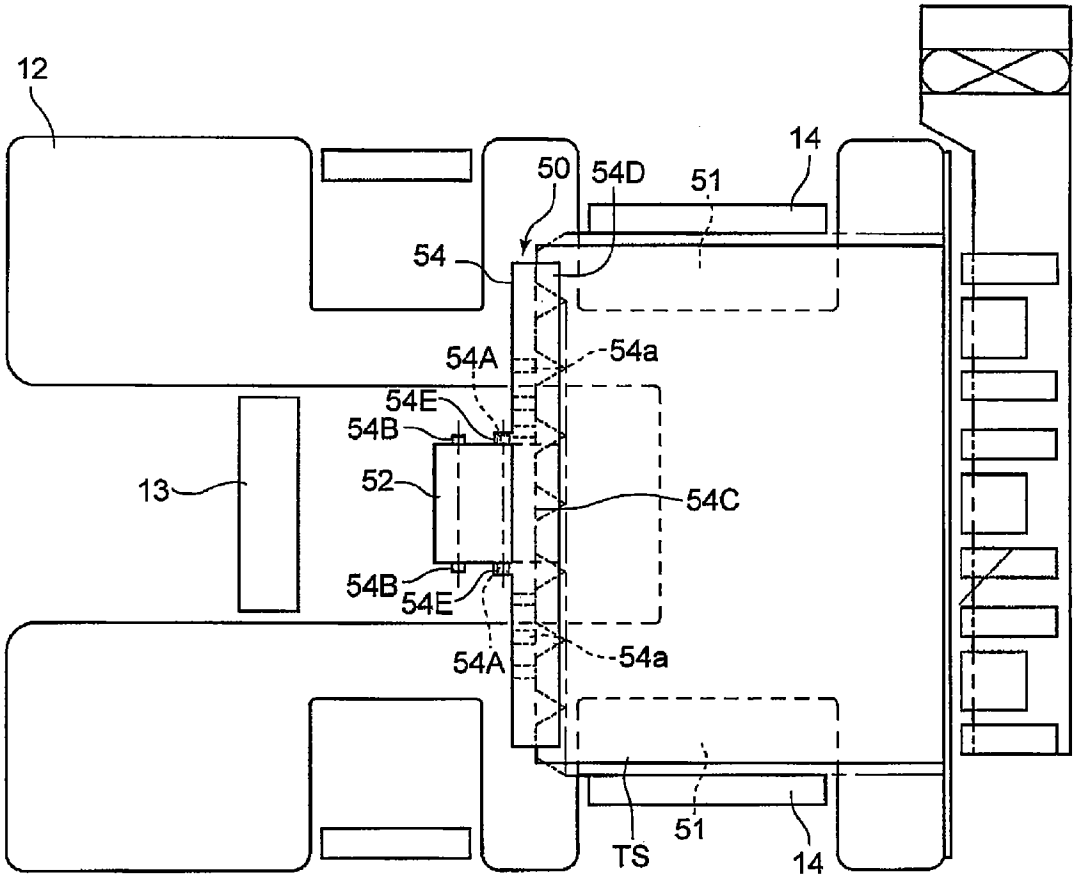
FIG. 7 is a plan view illustrating a state in which the tabbed sheet support unit is set in the tray of the sheet feeding apparatus.

FIG. 6 is a sectional side view illustrating a state in which a tabbed sheet support unit 50 is attached to the tray 12 of the sheet feeding apparatus 103, and FIG. 7 is a plan view illustrating the state in which the tabbed sheet support unit 50 is attached to the tray 12.

The tabbed sheet support unit 50 includes a tabbed sheet table 51, and the tabbed sheet table 51 is of the stacking portion on which the tabbed sheets are stacked. The tabbed sheet table 51 is detachably attached by a positioning unit (not illustrated) such that the tray surface does not rattle. The tabbed sheet support unit 50 includes a tabbed sheet regulating member 54 having a predetermined height. The tabbed sheet regulating member 54 is of the regulating portion which is provided on a side surface (surface on the upstream side in the sheet feeding direction) on the upstream side in the sheet feeding direction of the tabbed sheet table 51 while vertically moved.

The tabbed sheet regulating member (hereinafter referred to as regulating member) 54 abuts on the tabs TSa of the tabbed sheets TS to regulate the tabbed sheets TS. The tabbed sheets TS are placed on the tabbed sheet table 51 while the tabs TSa are located on the upstream side in the sheet feeding direction. As illustrated in FIG. 7, the tabbed sheet regulating member 54 is formed so as to be able to abut on all the tabs TSa of the tabbed sheets TS to regulate the tabbed sheets TS.

A support member 52 is attached to the rear end of the tabbed sheet table 51, and the support member 52 supports the tabbed sheet regulating member 54 while the tabbed sheet regulating member 54 can slidably be moved in the vertical direction. A first support portion 53A and a second support portion 53B are provided in the support member 52 with a predetermined interval in the sheet feeding direction.

The provision of the first and second support portions 53A and 53B can change the position of the tabbed sheet regulating member 54 in parallel with the sheet feeding direction illustrated by the arrow S of FIG. 6. Therefore, the tabbed sheet regulating member 54 can selectively be moved to the regulation positions where the tabbed sheets having different sizes (for example, A4 and LTR) whose sheet feeding lengths differ from each other can be regulated. The number of support portions may be increased so as to deal with at least two kinds of the tabbed sheets, and the regulation position is changed according to the sheet size.

The tabbed sheet regulating member 54 includes an engagement groove 54E. The engagement groove 54E is vertically extended to selectively engage one of the first and second support portions 53A and 53B. The engagement groove 54E engages one of the first and second support portions 53A and 53B, whereby the support member 52 supports the one of the first and second support portions 53A and 53B while one of the first and second support portions 53A and 53B is slidably moved in the vertical direction (direction of the arrow G).

In the embodiment, each of the first and second support portions 53A and 53B is formed by two ball bearings vertically provided or a roller having a low surface friction resistance, thereby smoothly moving the tabbed sheet regulating member 54 in the direction of the arrow G.

The tabbed sheet regulating member 54 also includes an abutment portion 54C and a contacting portion 54D. The abutment portion 54C abuts on the tab TSa of the tabbed sheet TS. The contacting portion 54D is projected from the upper end of the abutment portion 54C toward the upstream side in the sheet feeding direction, and the contacting portion 54D presses the rear-end part of the tabbed sheet TS from above.

Because the contacting portion 54D abuts on the top-most sheet of the tabbed sheets TS the tabbed sheet regulating member 54 is supported while being movable according to an amount of stacked tabbed sheets TS. As shown in FIG. 6, the contacting portion 54D abuts on the surface of the tabbed sheet table 51 when the tabbed sheet does not exist. FIG. 6 illustrates the state before the tabbed sheets TS are stacked on and supported by the tabbed sheet table 51. The tabbed sheet regulating member 54 is lowered by a dead weight. Alternatively, the tabbed sheet regulating member 54 may forcedly be lowered using an elastic member such as a spring.

In FIG. 6, the numeral H1 designates a vertical length (distance) from the tray 12 to the sheet stacking surface of the tabbed sheet table 51, and the numeral H2 designates a length from a bottom surface of the contacting portion 54D of the tabbed sheet regulating member 54 to the lower end. As shown in FIG. 6, a minimum gap H3 exists between the tray 12 and the regulating member 54.

That is, in the embodiment, the vertical length of the tabbed sheet regulating member 54 is set so as not to abut on the top surface of the tray 12 when the tabbed sheet is run out. Therefore, when the tray 12 is lifted, the tabbed sheet regulating member 54 can be kept in the state in which the tabbed sheet regulating member 54 is contacted on the tabbed sheet irrespective of the number of stacked tabbed sheets.

Because the vertical length of the tabbed sheet regulating member 54 is set as described above, the tabbed sheet regulating member 54 does not abut on the tray 12 when the tabbed sheet is run out. Therefore, when the tabbed sheet is run out, the projection amount of the tabbed sheet regulating member 54 from the surface of the tabbed sheet table 51 can be suppressed up to a height H4 of the contacting portion 54D.

An opening (not illustrated) is formed in the tabbed sheet table 51 such that a flag (not illustrated) of the sheet detection sensor (not illustrated) can enter the opening (not illustrated), whereby the sheet detection sensor can detect the absence of the sheet.

The tabbed sheet feeding operation of the sheet feeding apparatus 103 in which the tabbed sheet support unit 50 is attached to the tray 12 will be described below.

As described above, when the user draws the sheet storage case 11 to set the tabbed sheets on the tabbed sheet table 51 attached to the tray 12, the lifting of the tabbed sheet table 51 is started integral with the tray 12.

Figure 8:
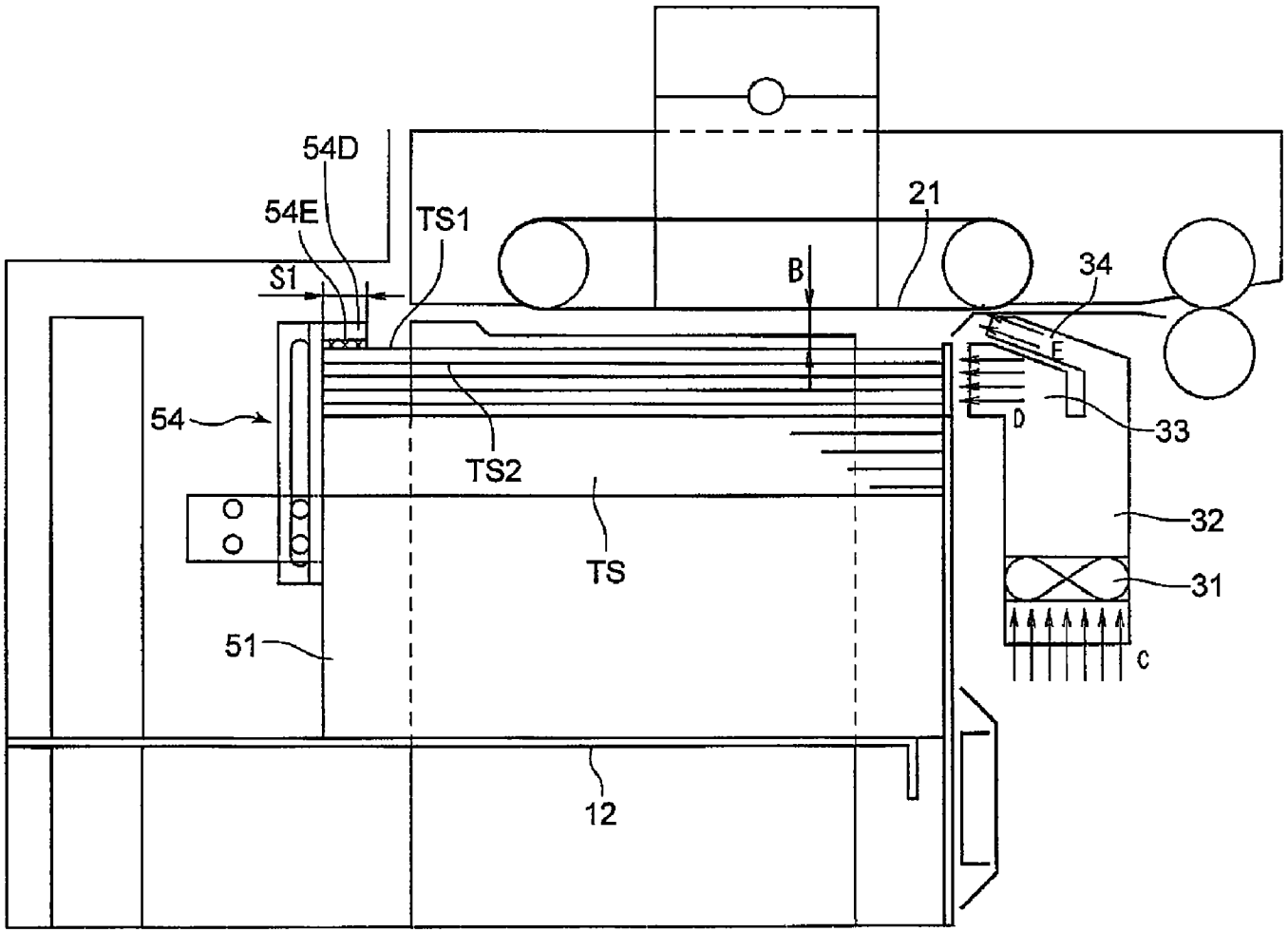
FIG. 8 is a first side view illustrating a state in which a tabbed sheet is fed in the sheet feeding apparatus when the tabbed sheet support unit is set.

As illustrated in FIG. 8, the distance between the suction conveying belt 21 and the top-most tabbed sheet TS1 on the tray 12 reaches the position B where the sheet can be fed, the controller 140 stops the tray 12 at the position B. Then, the controller 140 waits for the sheet feeding signal for starting the sheet feed.

When the controller 140 detects the sheet feeding signal, the controller 140 actuates the separation fan 31 to suck the air in the direction of the arrow C. The air passes through the separation duct 32, and the air is sprayed on the sheet TS on the tray 12 from the directions of the arrows D and E through the loosening nozzle 33 and the separation nozzle 34 respectively, thereby floating several upper sheets TS.

Plural slits 54*a* are formed in the tabbed sheet regulating member 54 such that the air sprayed from the front-end side of the sheet flows smoothly from the front side to the rear side (see FIG. 7). After the air is sprayed on the tabbed sheets TS, the lifting and lowering of the tray 12 is controlled using the sheet surface detecting sensor 38 such that the top surface of the tabbed sheets TS reaches a predetermined position. The tray 12 is stopped when the top surface of the tabbed sheets TS reaches the predetermined position.

When the floating of the tabbed sheets TS is stabilized after a predetermined time elapses since the sheet feeding signal is detected, the suction shutter 37 is rotated to generate the suction force from the suction holes made in the suction conveying belt 21. Only the top-most tabbed sheet TS1 is sucked to the suction conveying belt 21 by the suction force and the separation air from the separation nozzle 34. Then, the top-most tabbed sheet TS1 is conveyed while drawn to the suction conveying belt 21.

In feeding the tabbed sheet TS, the tray 12 is lifted according to the decrease of the amount of stacked sheet such that the distance between the top-most tabbed sheet TS1 and the suction conveying belt 21 reaches the predetermined position where the sheet can be fed. At this point, the tabbed sheet regulating member 54 is reversely moved relative to the direction in which the tray 12 is lifted. In feeding the tabbed sheet TS, the rear-end position of the tabbed sheet TS is always regulated by the tabbed sheet regulating member 54.

In setting the tabbed sheets S on the tabbed sheet table 51, the tray 12 is located at a lower limit position illustrated in FIG. 8, and whereby the tabbed sheet table 51 is located at a position illustrated in FIG. 8. In the case where the tabbed sheets S are set on the tabbed sheet table 51, after the tabbed sheet regulating member 54 is pulled up, the tabbed sheets S are set on the tabbed sheet table 51 such that the tabs of the tabbed sheets S are located on the upstream side in the sheet feeding direction.

When the user releases hands from the tabbed sheet regulating member 54, the contacting portion 54D of the tabbed sheet regulating member 54 is contacted on the top-most tabbed sheet TS1 by the deadweight. Therefore, in the sheet feeding operation, when the top-most sheet TS1 of the tabbed sheets is delivered by a projection length S1 of the contacting portion 54D, the tabbed sheet regulating member 54 is lowered by the deadweight, the contacting portion 54D abuts on the rear-end part of the tabbed sheet TS2 located immediately below the top-most sheet TS1. The contacting portion 54D is also used as an index for regulating the maximum amount the stacked tabbed sheet S.

In the embodiment, a separation assist sheet 54E made of a material having a high friction coefficient adheres to the sheet abutting surface side of the contacting portion 54D of the regulating member 54. Therefore, when the top-most tabbed sheet TS1 in the fed state brings along the tabbed sheet TS2 located immediately below the top-most sheet TS1, a friction force is generated between the contacting portion 54D and the tabbed sheet TS2 by a weight of the regulating member 54, which allows the multi feed of the tabbed sheet TS2 to be suppressed.

When the tabbed sheets TS are sequentially fed, the tabbed sheet table 51 is gradually lifted along with the tray 12 such that the distance between the top-most tabbed sheet TS1 and the suction conveying belt 21 always becomes the position B.

When the tabbed sheet table 51 is lifted, the tabbed sheet regulating member 54 is not lifted integral with the tabbed sheet table 51, but the tabbed sheet regulating member 54 is kept at the sheet feeding start position by the deadweight. Accordingly, the top-most tabbed sheet TS1 is fed one by one, and the tabbed sheet regulating member 54 abuts continuously on the top-most tabbed sheet TS1 even if the tabbed sheet table 51 is lifted.

Figure 9:
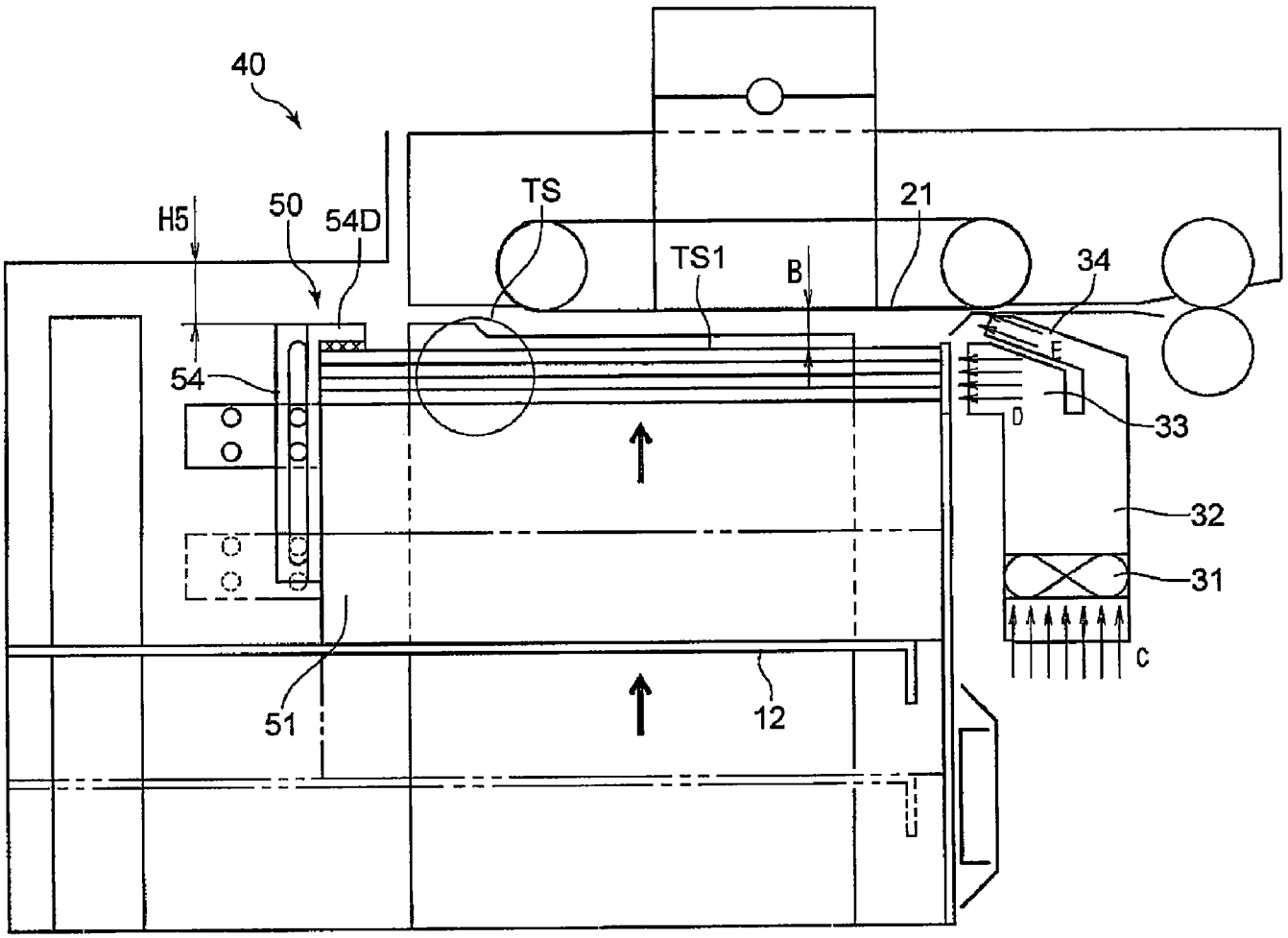
FIG. 9 is a second side view illustrating the state in which the tabbed sheet is fed in the sheet feeding apparatus when the tabbed sheet support unit is set.
Figure 10:
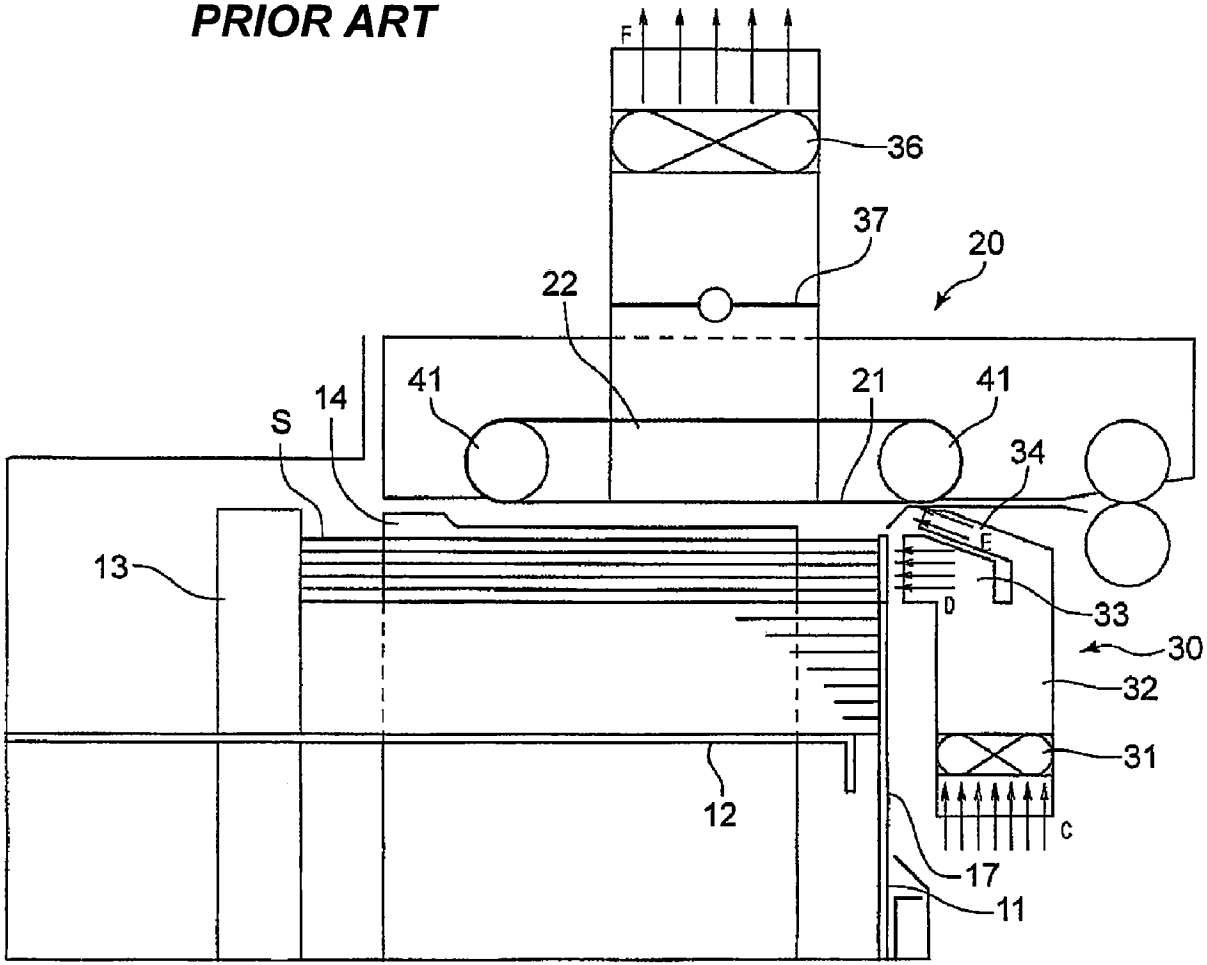
PRIOR ART FIG. 10
FIG. 10 illustrates a configuration of a conventional sheet feeding apparatus.
Figure 11:
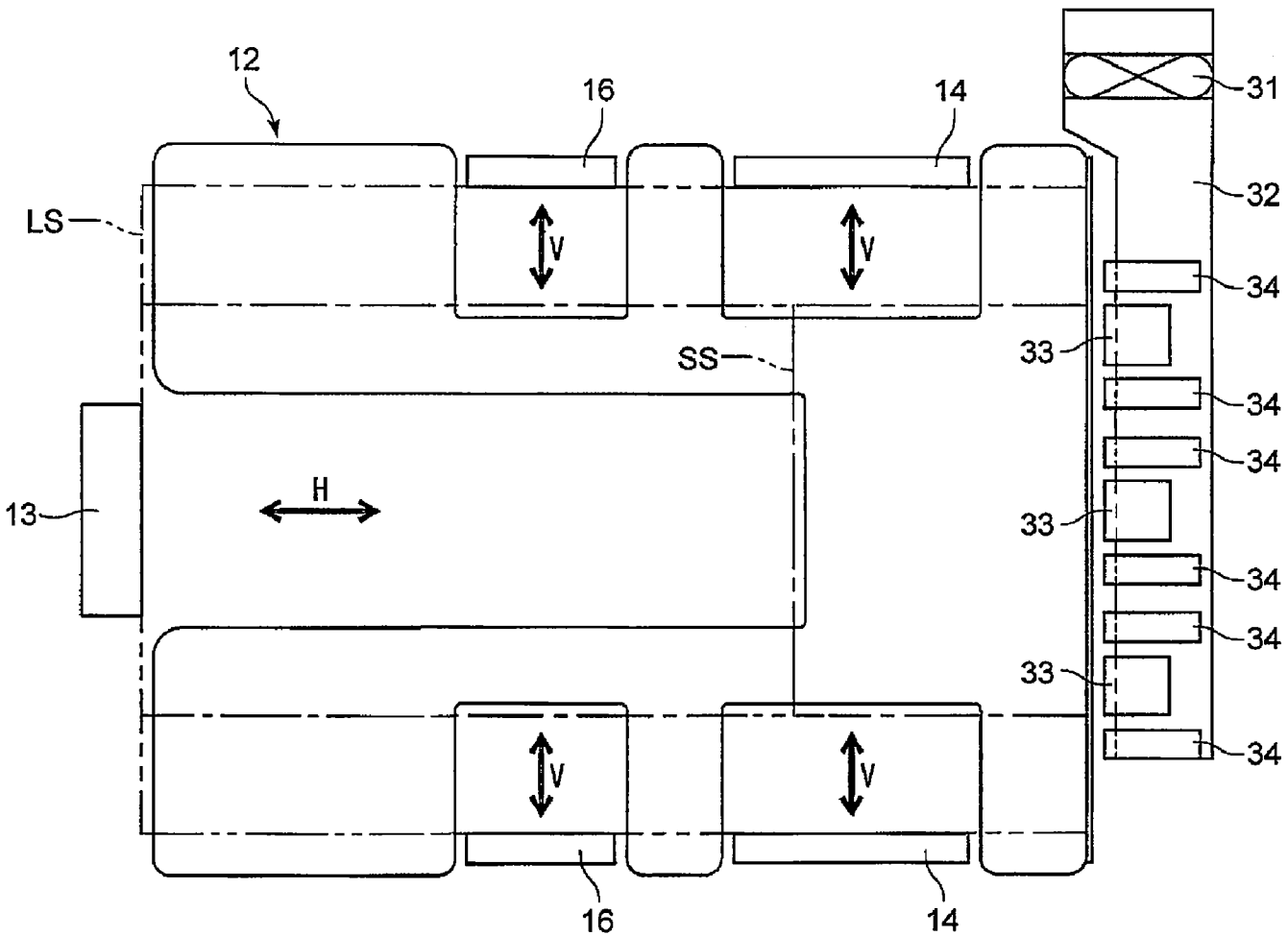
PRIOR ART FIG. 11
FIG. 11 is a plan view illustrating a detailed storage case of the conventional sheet feeding apparatus.
Figure 12:
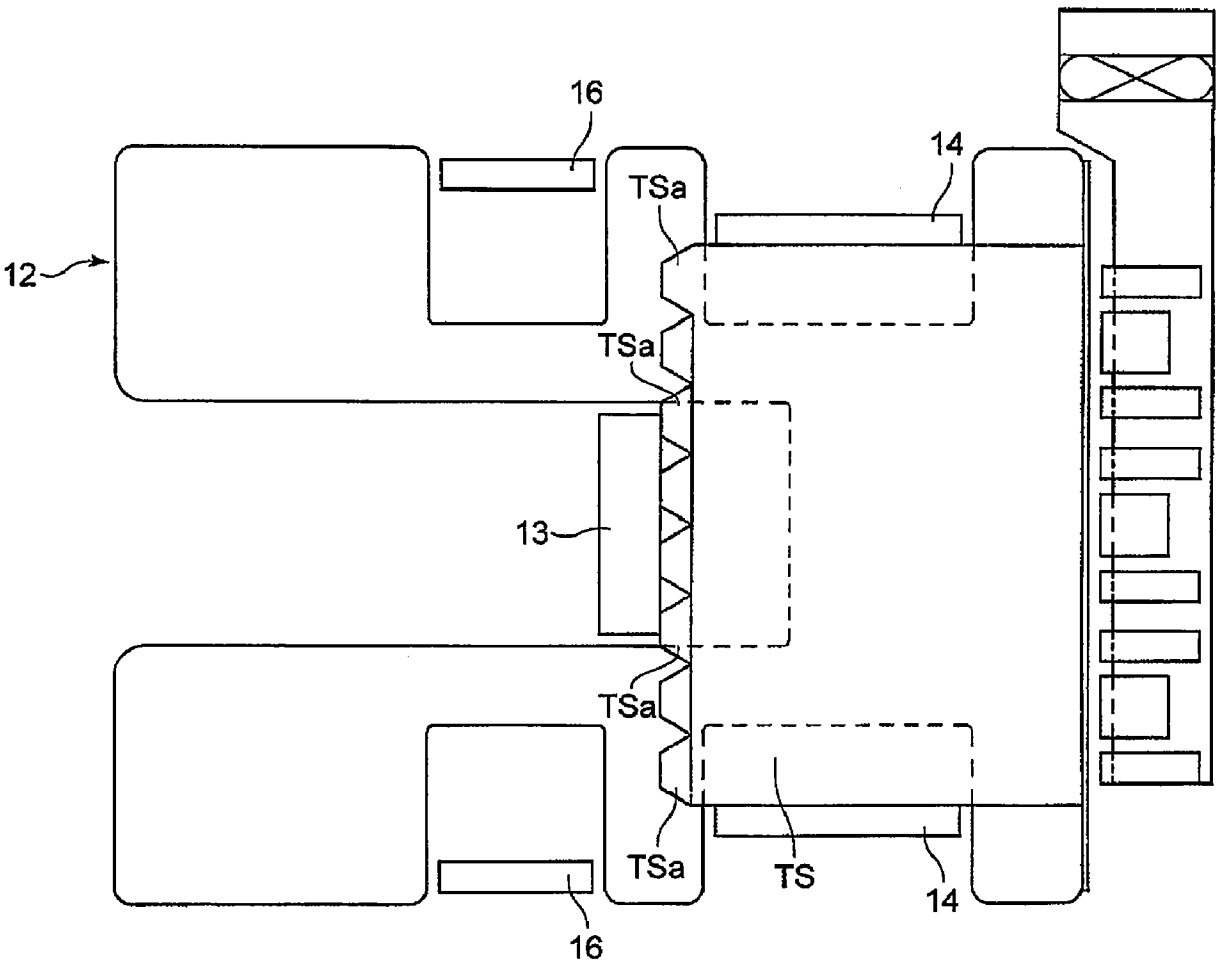
PRIOR ART FIG. 12
FIG. 12 is a plan view illustrating a state in which the tabbed sheets are stored in the storage case of the conventional sheet feeding apparatus.
Figure 13:
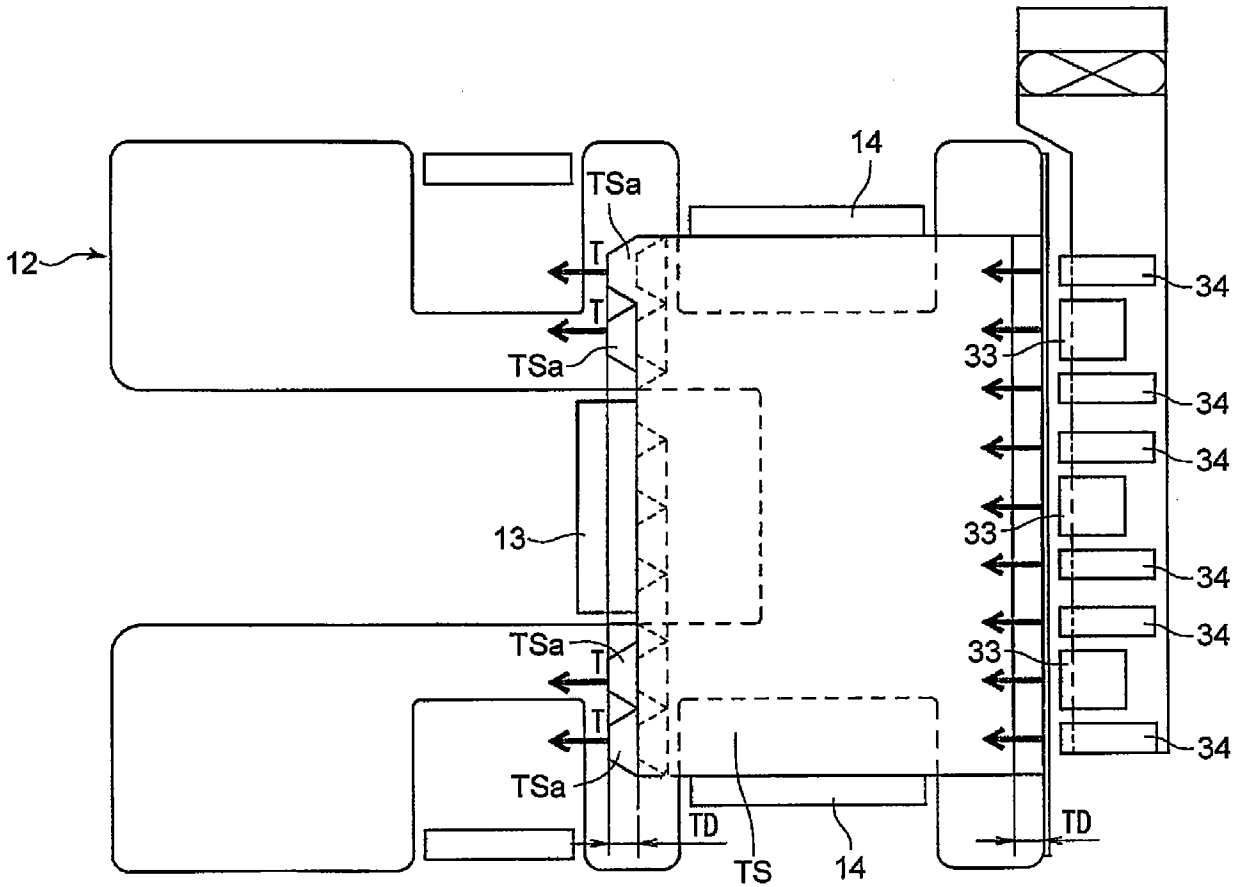
FIG. 13 PRIOR ART
FIG. 13 is a plan view illustrating a state in which the tabbed sheet of the conventional sheet feeding apparatus is fed.
Figure 14:
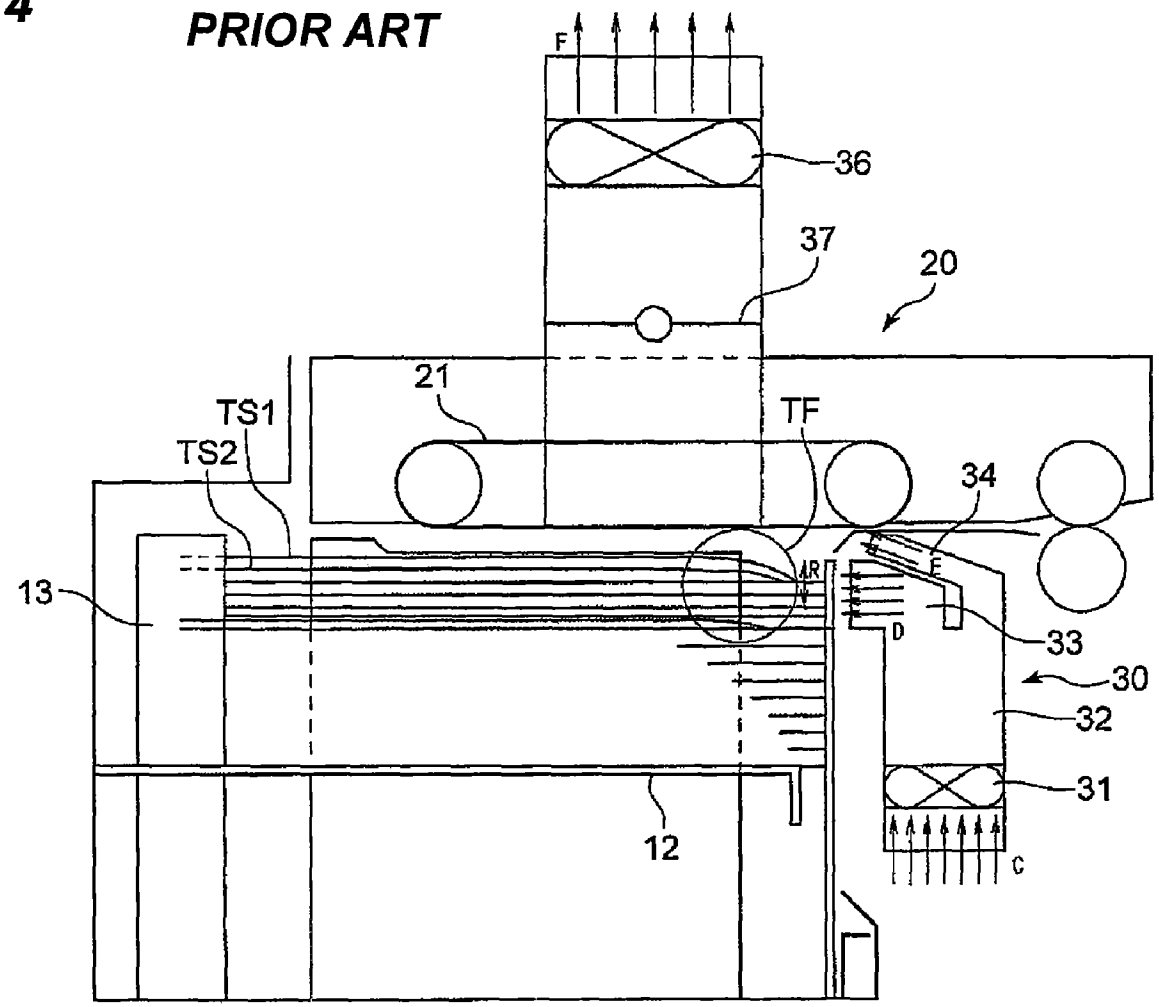
FIG. 14 PRIOR ART
FIG. 14 is a side view illustrating a state in which the tabbed sheet of the conventional sheet feeding apparatus is fed.
Figure 15:
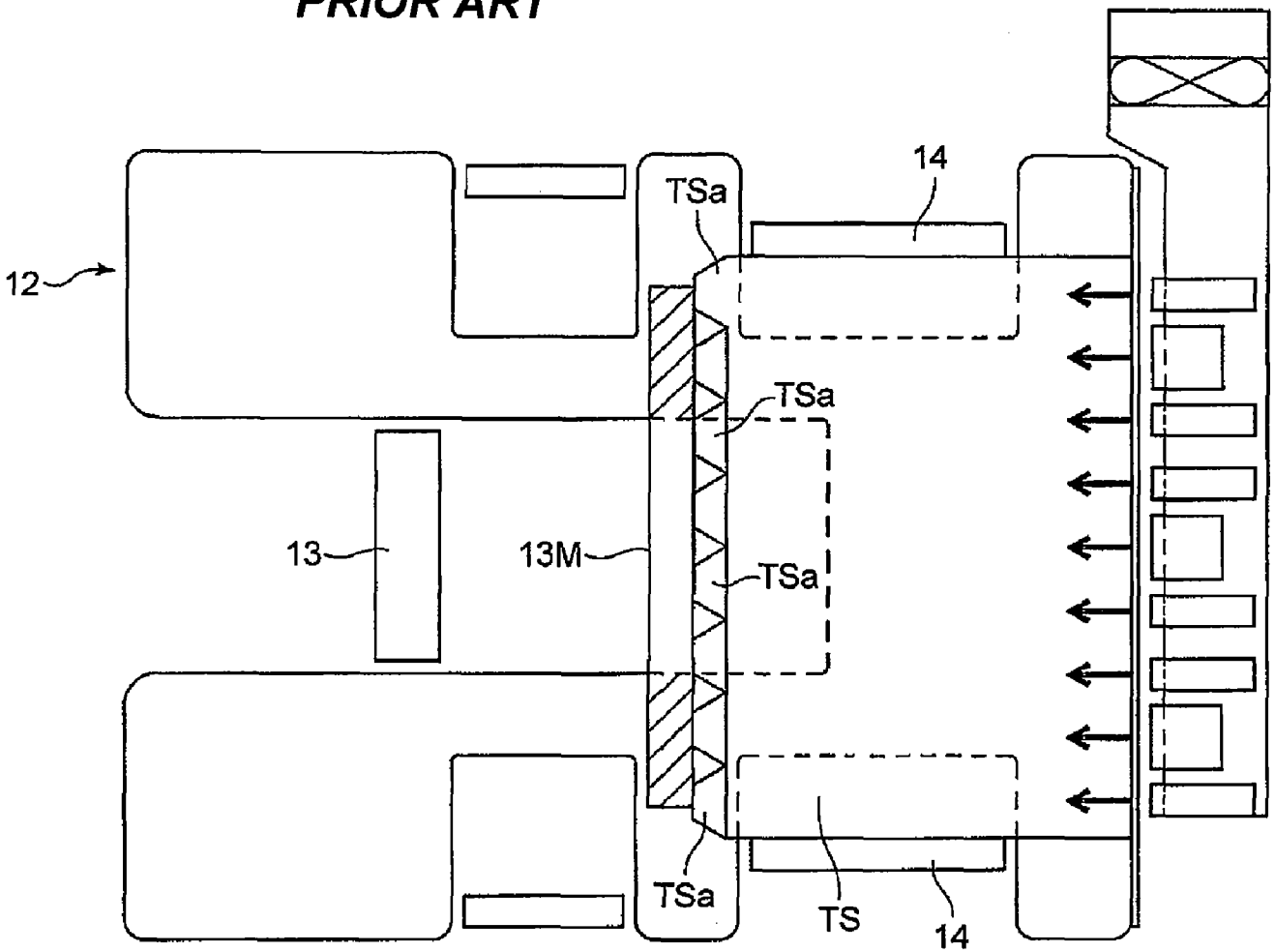
PRIOR ART FIG. 15
FIG. 15 is a plan view illustrating a state in which a tab guide is provided in the storage case of the conventional sheet feeding apparatus.
Figure 16:
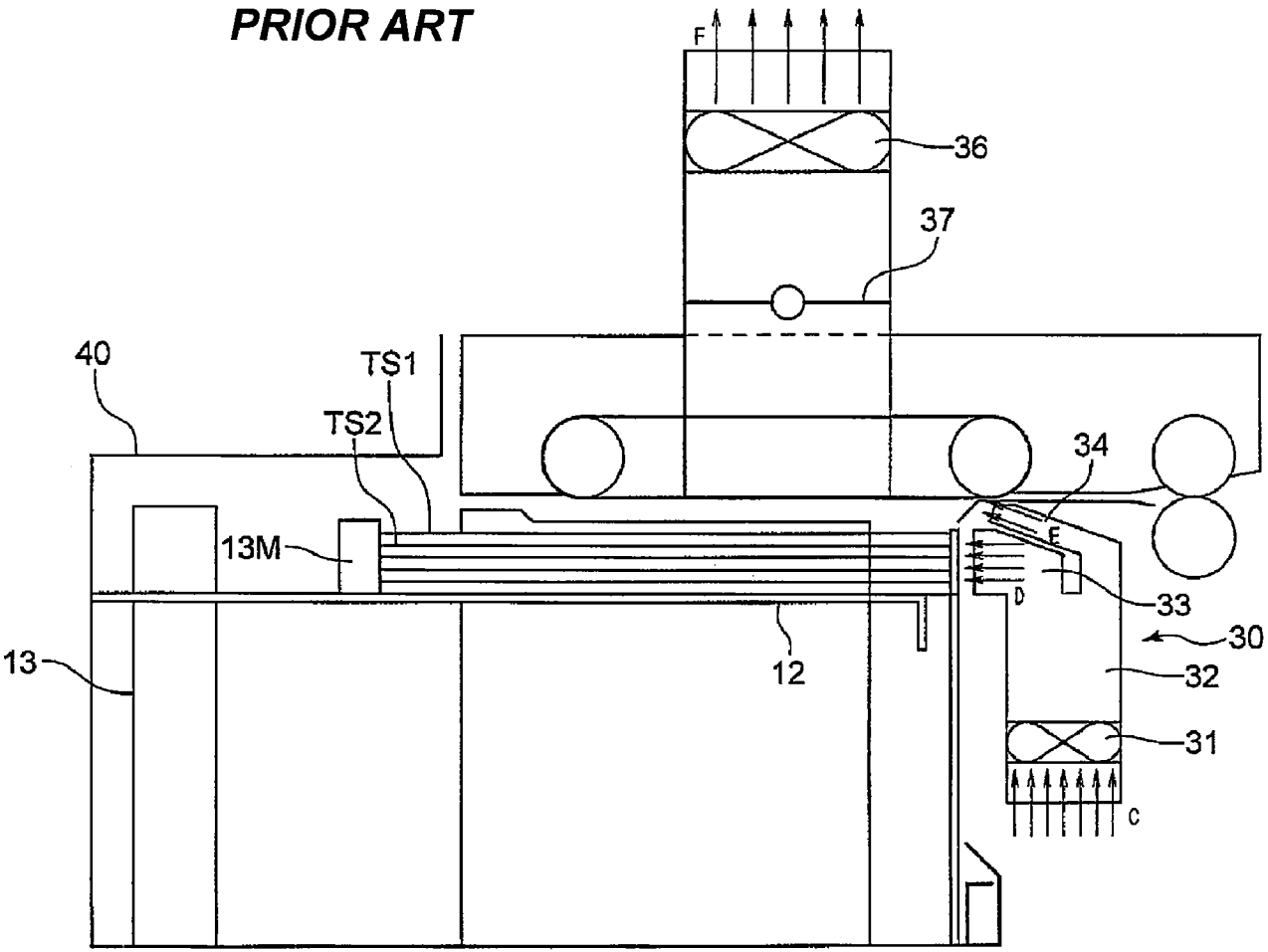
PRIOR ART FIG. 16
FIG. 16 is a sectional view illustrating a state in which the tab guide is provided in the conventional sheet feeding apparatus.

That is, the position at which the tabbed sheet regulating member 54 abuts on the top-most tabbed sheet TS1 is not changed even if the top-most tabbed sheet TS1 is fed one by one to lift the tabbed sheet table 51. Therefore, as illustrated in FIG. 9, a distance H5 between the tabbed sheet regulating member 54 and the component 40 constituting the printer body 101 is not changed even if the tabbed sheet table 51 is lifted along with the tray 12 according to the top surface position of the sheets on the tabbed sheet table.

When the feed of the final tabbed sheet is ended, the contacting portion 54D of the tabbed sheet regulating member 54 abuts on the surface of the tabbed sheet table 51. Then, when the tray 12 is lifted, the tabbed sheet regulating member 54 is lifted along with the tabbed sheet table 51, and the tabbed sheet regulating member 54 collides with the printer body 101.

In the embodiment, the tray 12 is lowered in order to prevent the collision with the printer body 101 when the sheet detecting unit (not illustrated) detects that the feed of the final tabbed sheet is ended.

Therefore, at the time the feed of the final tabbed sheet is ended, the tabbed sheet regulating member 54 abutting on the surface of the tabbed sheet table 51 can be lifted along with the tray 12 to prevent the collision of the contacting portion 54D of the regulating member 54 with the component 40 constituting the printer body 101. That is, the contacting portion 54D of the regulating member 54 can brought close to the component to the utmost limit in a range in which the lowering of the tray 12 is started at a time the distance H5 does not become "0".

The vertical length of the regulating member 54 is set so as to maintain the state in which the tabbed sheet regulating member 54 is contacted on the tabbed sheet irrespective of the lifting of the tray 12, which allows the regulating member 54 to be prevented from colliding with the printer body 101.

Although the invention is applied to the air sheet feeding system sheet feeding apparatus in the embodiment, the invention is not limited to the air sheet feeding system sheet feeding apparatus. For example, the invention can be applied to the sheet feeding apparatus in which the sheet is fed by the roller while lifted and lowered by the tray. In such cases, the amount of stacked tabbed sheet can be increased to obtain the high operability, and the increase of the interval between the continuously fed sheets can be prevented to maintain the productivity. Additionally, the generation of the delay jam can also be prevented.

In this embodiment, the tabbed sheet support unit is detachably attached when the tabbed sheet is used. However, the invention is not limited to this embodiment. For example, in the sheet feeding apparatus dedicated to the tabbed sheet, the tabbed sheet support unit may fixedly be provided in the sheet feeding apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-162860, filed Jun. 20, 2007, which is hereby incorporated by reference herein in its entirety.

What is claimed is:

1. A sheet feeding apparatus comprising:

a tray which stacks and supports a sheet, the tray being lifted and lowered according to an amount of stacked sheet;

a tabbed sheet support unit detachably attached in the sheet feeding apparatus and the tabbed sheet support unit stacks tabbed sheets; and a sheet feeding portion which feeds the sheet stacked on the tray or the tabbed sheets stacked on the tabbed sheet support unit when the tabbed sheet support unit is attached in the sheet feeding apparatus, wherein the tabbed sheet support unit includes:

a stacking portion which is detachably attached on an upper surface that supports the sheet of the tray to stack the tabbed sheets; and a regulating portion which is provided in the stacking portion, the regulating portion abutting on a tab of the tabbed sheet on the stacking portion to regulate an end position of the tabbed sheet, on an upstream side in a sheet feeding direction, wherein the regulating portion is movably supported in a vertical direction by the stacking portion according to the amount of tabbed sheet stacked on the stacking portion, when the tabbed sheet support unit is attached on the tray.

2. The sheet feeding apparatus according to claim 1, comprising:

a support portion which is provided in the stacking portion, the support portion supporting the regulating portion so that the regulating portion is slidably movable in a vertical direction; and a contacting portion which is provided in the regulating portion, the contacting portion abutting on a top surface of the tabbed sheet on the stacking portion, wherein the regulating portion is moved according to the amount of stacked tabbed sheet.

3. The sheet feeding apparatus according to claim 2, wherein a member having a high friction coefficient with the sheet is provided on a sheet abutting surface side of the contacting portion.

4. The sheet feeding apparatus according to claim 1, wherein the tray is provided while being able to be lifted according to a decrease of the amount of stacked sheet stacked on the stacking portion, and the regulating portion is reversely moved relative to a direction in which the tray is lifted according to the decrease of the amount of stacked sheet stacked on the stacking portion.

5. The sheet feeding apparatus according to claim 1, wherein a position where the tabbed sheet is regulated in a sheet feeding direction by the regulating portion can be changed according to a sheet size.

6. The sheet feeding apparatus according to claim 1, wherein the sheet feeding portion includes:

an air spraying portion which sprays air in order to float the sheet supported by the tray; and a suction conveying portion which sucks and conveys the sheet floated by the air spraying portion.

7. An image forming apparatus comprising:

a tray which stacks and supports a sheet, the tray being lifted and lowered according to an amount of stacked sheet;

a tabbed sheet support unit detachably attached in the sheet feeding apparatus and the tabbed sheet support unit stacks tabbed sheets; and a sheet feeding portion which feeds the sheet stacked on the tray or the tabbed sheets stacked on the tabbed sheet support unit when the tabbed sheet support unit is attached in the sheet feeding apparatus, and an image forming portion which forms an image on the sheet, wherein the tabbed sheet support unit includes:

a stacking portion which is detachably attached on an upper surface that supports the sheet of the tray to stack the tabbed sheets; and a regulating portion which is provided in the stacking portion, the regulating portion abutting on a tab of the tabbed sheet on the stacking portion to regulate an end position of the tabbed sheet on an upstream side in a sheet feeding direction, and wherein the regulating portion is movably supported in a vertical direction by the stacking portion according to the amount of tabbed sheet stacked on the stacking portion, when the tabbed sheet support unit is attached on the tray.

8. The image forming apparatus according to claim 7, comprising:

a support portion which is provided in the stacking portion, the support portion supporting the regulating portion so that the regulating portion is slidably movable in a vertical direction; and a contacting portion which is provided in the regulating portion, the contacting portion abutting on a top surface of the tabbed sheet on the stacking portion, wherein the regulating portion is moved according to the amount of stacked tabbed sheet.

9. The image forming apparatus according to claim 8, wherein a member having a high friction coefficient with the sheet is provided on a sheet abutting surface side of the contacting portion.

10. The sheet feeding apparatus according to claim 7, wherein the tray is provided while being able to be lifted according to a decrease of the amount of stacked sheet stacked on the stacking portion, and the regulating portion is reversely moved relative to a direction in which the tray is lifted according to the decrease of the amount of stacked sheet stacked on the stacking portion.

11. The sheet feeding apparatus according to claim 7, wherein a position where the tabbed sheet is regulated in a sheet feeding direction by the regulating portion can be changed according to a sheet size.

12. The sheet feeding apparatus according to claim 7, wherein the sheet feeding portion includes:

an air spraying portion which sprays air in order to float the sheet supported by the tray; and a suction conveying portion which sucks and conveys the sheet floated by the air spraying portion.

* * * * *